United States Patent [19]

Hillstrom et al.

[11] 4,138,313

[45] Feb. 6, 1979

[54] METHOD AND APPARATUS FOR CONTINUOUSLY WASHING FIBROUS SUSPENSIONS AND CONTROLLING THE VOLUME OF WASH LIQUID

[75] Inventors: Per A. R. Hillstrom, Domsjo; Lars G. Norehall, Ornskoldsvik, both of Sweden

[73] Assignee: Mo och Domsjo Aktiebolag, Ornskoldsvik, Sweden

[21] Appl. No.: 785,399

[22] Filed: Apr. 7, 1977

[30] Foreign Application Priority Data

Apr. 14, 1976 [SE] Sweden ..... 7604431

[51] Int. Cl.[2] ..... D21C 9/02

[52] U.S. Cl. ..... 162/49; 8/156; 162/60; 162/252; 162/263; 162/DIG. 10

[58] Field of Search ..... 162/49, 60, 252, 253, 162/263, 61, DIG. 10, 17, 19; 73/61 R; 137/5, 6, 88; 23/230 A, 253 A; 235/151.12, 150.1; 68/181 R; 8/156, 158

[56] References Cited

U.S. PATENT DOCUMENTS

| | | | |
|---|---|---|---|
| 2,745,712 | 5/1956 | Burling et al. | 162/60 X |
| 3,802,964 | 4/1974 | Forgacs et al. | 162/263 |
| 3,888,726 | 6/1975 | Hultman | 162/49 |
| 4,014,736 | 3/1977 | Sexton | 8/156 X |

FOREIGN PATENT DOCUMENTS

| | | | |
|---|---|---|---|
| 993541 | 7/1976 | Canada | 162/DIG. 10 |
| 2163039 | 7/1973 | France | 162/DIG. 10 |

OTHER PUBLICATIONS

Rydholm "Pulping Processes," Interscience Publishers, New York, pp. 722–733.

"Kamyr Continuous Diffuser," Kamyr, Sweden, brochure.

*Primary Examiner*—S. Leon Bashore

*Assistant Examiner*—Steve Alvo

[57] ABSTRACT

A process and apparatus are provided for controlling the supply of aqueous suspending liquid in continuously washing fibrous suspensions in aqueous suspending liquors containing dissolved impurities, to remove such impurities by exchanging aqueous suspending liquors substantially free from such impurities for the aqueous suspending liquor, which comprises washing fibrous material of the suspension in aqueous suspending liquid substantially free from dissolved impurities, and forming a washed fibrous suspension in such liquid; withdrawing aqueous suspending liquor containing dissolved impurities; diluting the washed fibrous suspension by adding aqueous suspending liquid substantially free from dissolved impurities; determining the amount of dissolved impurities remaining with the fibrous suspension after the washing has been completed by measuring (1) the volumetric flow rate of the washed suspension; (2) the liquid content of the washed suspension; and (3) the content of dissolved impurities in the suspending liquid; and then controlling the volume amount of wash liquid added according to the washing losses to maintain washing losses within a predetermined limiting range.

8 Claims, 1 Drawing Figure

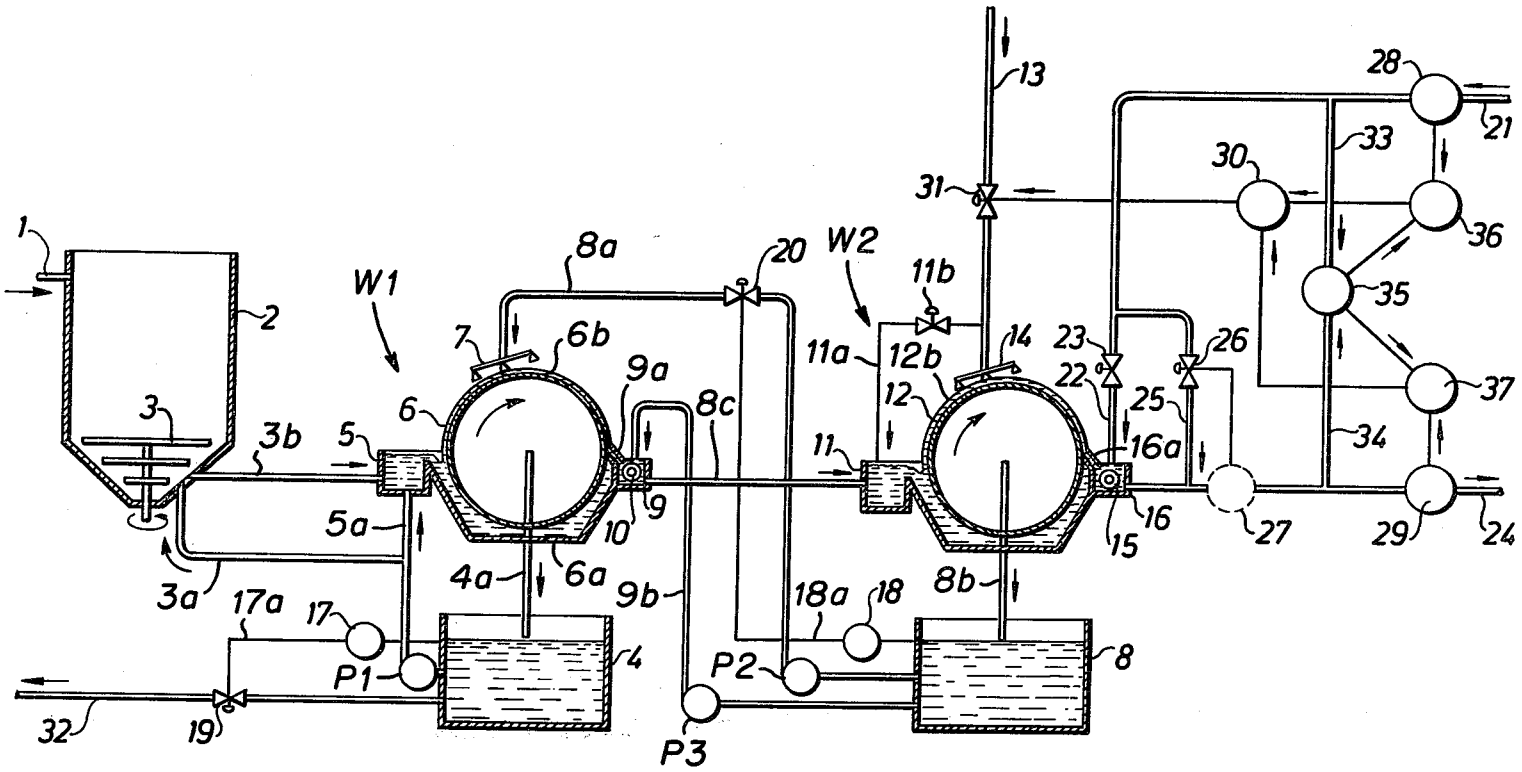
1
2
3
3a
3b
4
4a
5
5a
6
6a
6b
7
8
8a
8b
8c
9
9a
9b
10
11
11a
11b
12
12b
13
14
15
16
16a
17
17a
18
18a
19
20
21
22
23
24
25
26
27
28
29
30
31
32
33
34
35
36
37
W1
W2
P1
P2
P3

METHOD AND APPARATUS FOR CONTINUOUSLY WASHING FIBROUS SUSPENSIONS AND CONTROLLING THE VOLUME OF WASH LIQUID

Cellulose pulp is normally washed after separation of the pulping liquor at the conclusion of the digestion, before it is passed on to subsequent chemical treatment stages, such as bleaching. The pulping liquor contains substantial quantities of dissolved impurities, which react with treating chemicals, and if these impurities are not removed, or the concentration thereof at least greatly reduced, subsequent chemical treatments applied to the pulp, particularly bleaching, may be relatively ineffective, because of the consumption of such chemicals by the impurities. The impurities therefore not only reduce the bleaching effect, but may also require the addition of larger amounts of the treating agents, which are largely wasted. Dissolved impurities present in the pulping liquor after digestion include the pulping chemicals and the organic substances formed in the course of the pulping process which are water-soluble and become dissolved in the liquor.

The dissolved impurities accordingly accompany the cellulose pulp suspension, and are removed by the washing.

The impurities are valuable as a source of fuel, and therefore can be burned, utilizing the heat elsewhere in the pulp mill. Inorganic materials which are burned are recovered as smelts in the combustion residues, and the smelt can be recycled as a source of pulping chemical values, particularly sulfur and alkali. The dissolved water-soluble materials present in the pulping liquor and in the suspending liquor for the fibrous cellulose pulp suspension can be collectively referred to as the solids content of the liquor, and the solids content is normally expressed as a percentage equal to the total quantity of solids materials, i.e., organic and inorganic materials present, divided by the total quantity of pulping liquor.

Accordingly, the cellulose pulp washing system is designed to remove the dissolved impurities, and this is normally done by simply replacing the aqueous suspending liquor containing dissolved impurities with a fresh or relatively pure aqueous suspending liquid, substantially free from such impurities, or at least having a lower content thereof than the aqueous suspension from the pulper or digester.

Cellulose pulp washing systems are highly specialized, and a special terminology has been developed to refer to various aspects thereof. Several of the more important and more commonly encountered terms are defined below:

Original black liquor: The pulping liquor which serves as a suspending medium for the cellulose pulp in the digester, at the conclusion of the pulping process. This liquor contains dissolved pulping chemicals, and also inorganic and organic material produced as by-products from the pulping reaction, including organic water-soluble material dissolved from the wood.

Recovered black liquor or release liquor: The black liquor which is obtained subsequent to washing the pulp and containing the dissolved solids present in the original black liquor. The recovered black liquor is passed to the evaporation stage, where the liquor is concentrated to a heavy black liquor or thick black liquor.

Washing losses: The quantity of original black liquor dissolved solids which remains with the washed cellulose pulp suspension, after the washing has been completed. In Kraft pulping, the washing losses are expressed as kilograms of sodium sulfate per ton of pulp. In sulfite pulping, the washing losses are expressed as kilograms of $Na_2O$ or MgO per ton of pulp, depending upon whether sodium or magnesium base pulping liquor is used. In sulfite pulping, the washing losses can also be expressed as the total loss of solids, including both inorganic and organic materials. The washing losses can also be expressed in terms of $BOD_7$ or COD-loss. $BOD_7$ (measured in accordance with the standard analytical method SCAN-W 5:71) is an abbreviation for biochemical oxygen demand, i.e., the consumption of biochemical oxygen. The analytical procedure determines how much oxygen as $O_2$ the washing losses, i.e., the organic portion thereof, consumes after discharge in the atmosphere after seven days at a temperature of 20° C., measured biochemically. COD is an abbreviation for "chemical oxygen demand", and refers to the amount of chemical oxygen consumed. This determines how much oxygen as $O_2$ the organic portion and a portion of the inorganic materials consumes when discharged to the atmosphere, and measured chemically.

The washing losses vary according to the pulping process and the analytical technique used to determine it. The washing loss determination, however made, is a direct measurement of the efficiency of the washing system.

Dilution factor (DF): The difference between recovered black liquor and original black liquor, i.e., the quantity of black liquor in excess of the quantity of original black liquor charged, to obtain the desired washing. Dilution factor is often expressed in terms of ton or cubic meter of liquid per ton of pulp.

The term "dilution factor" can only be used in a closed washing system or sub system with four flows only as shown below:

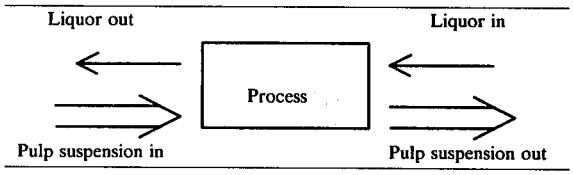

e.g. a process with:

one pulp suspension stream in,
one pulp suspension stream out,
one liquor stream in,
one liquor stream out.

The definition of dilution factor (DF) applied to this scheme gives:

DF = Liquor out—Liquor in pulp suspension in per unit of pulp.

When making a liquor balance over the system it can also be shown that:

DF = Liquor in—Liquor in pulp suspension out per unit of pulp.

The washing system described in FIG. 1 corresponds to this scheme. The corresponding numbers in FIG. 1 are:

1 = pulp suspension in
at 16a = pulp suspension out
13 = liquor in
32 = liquor out.

It should be noted that the washing system ends at the doctor blade 16a and that no liquor from the line 21 enters the washing system but is used only to make it possible to determine the amount of liquor in the pulp that leaves the washing system at 16a.

Fibrous cellulose pulp suspensions are normally washed in one or more washing stages. Usually, three or four washing stages are used. When a multiplicity of washing stages are employed, the stages are arranged in counterflow, i.e., the fresh washing liquid is supplied to the last stage, and then progresses forwardly towards the first washing stage, in series along the line of washing stages. In this way, the washing liquor containing a progressively greater proportion of dissolved impurities is utilized to wash the cellulose pulp fiber suspension containing a progressively lesser proportion of impurities, so that the washing liquor is re-used efficiently from stage to stage. In the final washing stage, the washing liquid, often pure water, can be expected to remove substantially all of the remaining dissolved impurities. The spent washing liquor containing the impurities dissolved from the starting cellulose pulp suspension is then collected, and the solids content can be recovered as desired.

For optimum washing efficiency, it is obviously desirable to carry out the washing with the least possible amount of washing loss, and the least possible dilution of the recovered black liquor. The smaller the washing loss, the cleaner the cellulose pulp, and the greater the proportion of pulping chemicals and organic substances recovered. The least possible dilution is desired because recovery of the dissolved chemicals then requires less energy in removal of the liquid.

Heretofore, there has been no practical method for continuously determining washing losses, so that washing losses can be regulated in a favorable manner. Normally, the washing losses are estimated, based on a sampling of the pulp suspension as it leaves the last washing stage, determining the solids content i.e. the content of dissolved organic and/or inorganic material, in the sample of suspending liquor of the washed suspension. Thus, if a wash filter is used, a sample is taken of the suspension immediately after it leaves the terminal wash filter in the series.

Normally, the washed pulp suspension has a solids content within the range from about 10 to about 15% as it leaves the last wash filter stage, which means that the pulp suspension is in the form of a web from which pulp samples can readily be taken. Suspending liquid is squeezed from the sample, and the content of dissolved inorganic material is determined, in accordance with the standard procedure of SCAN C 30:74.

This test procedure determines analytically the amount of sodium in the sample, and is thus primarily usable in cellulose pulping processes in which a sodium compound is used as the basic pulping chemical. In pulping plants using some other metal compound as the base chemical, such as calcium and magnesium, the analytical method must be modified so that this metal is determined instead of sodium. In accordance with this method, the washing losses are then expressed as kilograms of sodium sulfate per ton of dry pulp.

From the value obtained, it is possible to obtain an indication of the total washing losses to be expected, i.e., the quantity of organic and inorganic material that is lost with the pulp. If the level of washing losses is found to be acceptable, no remedial measures need be taken. If however the level of washing losses is exceedingly high, the amount of washing liquid charged to the last washing filtration stage is increased.

This method of control is very unreliable, however, since a considerable amount of time elapses between the time when a sample is taken and the time when the amount of dissolved solids has been determined, and too much or too little washing liquid may have been used, and the washing losses may have been unduly high, for some time. Moreover, processing of the pulp which passes through before the determination is completed may be inadequate, further down the line.

The sampling of the pulp web itself leads to inaccuracies. Modern washing machines produce very wide webs which can be nonuniform from one part to another. Moreover, the pulp web is often rewetted just as it is removed from the drum, due to foaming of the liquid within the wash filter. When this happens, the sample has already been taken, and since this liquid has a higher content of dissolved organic and inorganic material than the suspending liquid present in the sample, the subsequent analysis will show a lower washing loss than the true value.

Variations in washing losses also can be caused by a number of different factors. For example, the amount of organic material charged together with the pulp to the washing stage may suddenly increase, due to the fact that the quantity of organic material dissolved in the course of the pulping is higher than normal. Moreover, pulps from different pulping stages may be more difficult to wash than others, due to variations in the degree of delignification of the lignocellulosic material.

High washing losses are of course disadvantageous for many reasons. The chemicals that are lost are economically important, and their loss increases the cost of operation. Hence, it is desirable that the washing losses be kept as low as possible, with only a reasonable dilution factor. High washing losses also lead to problems in the subsequent treatment of the pulp. If an excessively large amount of dissolved impurities accompanies the pulp from the washing stage to the screening stage, and then on to the bleaching stage, there may be an unduly high consumption of bleaching chemicals and other treating chemicals.

There are two types of screening plants; open screening and relatively closed screening. When the pulp is screened through open screens, large quantities of water are added to dilute the pulp to a concentration suitable for the screening system. When the pulp leaves the screening stage, the pulp is dewatered to a pulp concentration within the range from about 7 to about 15%, a major part of the white water obtained being discharged as effluent. A large portion of the washing loss is dissolved in this white water, and therefore is discharged as well, which can increase the pollution problem.

When a relatively closed screening apparatus is used, the washing losses, i.e., the dissolved impurities, to a large extent accompany the pulp to the bleaching stage. Here, more bleaching agent then is used, since the impurities also react with the bleaching agent. Unless the washing losses are checked continuously, it is not possible to anticipate sudden increases in washing losses, and because of this consumption of bleaching agent, bleaching will be inadequate until additional bleaching chemical is charged to the system.

If this sort of situation is to be expected, then it is necessary, for uniform bleaching, to charge an excess of bleaching chemical to the bleaching stage, so as to be sure that the desired degree of bleaching of the pulp is obtained, even if the washing losses are momentarily high. This naturally increases the consumption of bleaching chemical, and also the amount of bleaching chemical impurities that are discharged at the conclusion of the bleaching stage.

Since there is no method for continuously determining washing losses, it has been very difficult for pulp manufacturing plants to maintain the amount of impurities discharged from the plant below the predetermined minimum set by the environmental control authorities. This naturally can seriously affect the operation of the plant, and can lead to heavy legal fines in the event that the limits imposed are violated, even though this be entirely accidental, and quite beyond the control of the mill operation.

In accordance with the present invention, it becomes possible to determine continuously the content of dissolved impurities, i.e., the washing losses, in the cellulose pulp suspension leaving the washing system, thereby making it possible to control the washing losses that are obtained in the washing. The process in accordance with the invention comprises controlling the supply of aqueous suspending liquid in continuously washing fibrous suspensions in aqueous suspending liquors containing dissolved impurities, to remove such impurities by exchanging aqueous suspending liquors substantially free from such impurities for the aqueous suspending liquor, and comprises washing fibrous material of the suspension in aqueous suspending liquid substantially free from dissolved impurities, and forming a washed fibrous suspension in such liquid; withdrawing aqueous suspending liquor containing dissolved impurities; diluting the washed fibrous suspension by adding aqueous suspending liquid substantially free from dissolved impurities; measuring the amount of dissolved impurities remaining with the fibrous suspension after the washing has been completed by determining (1) the volumetric flow rate of the washed suspension; (2) the liquid content of the washed suspension; and (3) the content of dissolved impurities in the suspending liquid; and then controlling the volume amount of wash liquid added according to the washing losses to maintain washing losses within a predetermined limiting range.

The process of the invention is applicable to any kind of fibrous cellulose pulp suspension, including chemical pulps, mechanical pulps, chemimechanical pulps, semichemical pulps, and thermomechanical pulps, for example, sulfite pulps, sulfate pulps, and pulps obtained from the oxygen alkali pulping of lignocellulosic material.

FIG. 1 shows a washing system for a pulp mill capable of producing chemical pulp, utilizing wash filters in two stages.

The washing system of FIG. 1 receives via line 1 the cellulose pulp directly from the digester, suspended in spent black liquor, containing dissolved impurities, and it is collected in a storage or flow-equalizing reservoir 2, provided with a stirrer 3 to maintain the suspension uniform. A line 3*a* at the bottom of the reservoir is in flow connection with the filtrate tank 4 receiving washing liquor via line 4*a* from the interior of the filter drum 6 in the first washing stage W1. The filtrate liquor in the tank 4 contains an appreciable proportion of the same types of dissolved solids present in the black liquor entering with the pulp via line 1. Filtrate liquor from tank 4 entering reservoir 2 via line 3*a* is used to dilute the pulp, aided by the stirrer 3, and is pumped from the tank 4 by the pump P1 for the purpose. The diluted pulp suspension, thoroughly mixed by the stirrer 3, then is led by the line 3*b* to the inlet box 5. The box 5 is in flow communication via line 5*a* with line 3*a* and the tank 4, and the pulp suspension can therefore be further diluted with liquor from the tank 4 while in the inlet box 5.

In normal operation, the cellulose pulp suspension in black liquor entering the reservoir 2 has a pulp concentration of approximately 12%. After dilution in two stages, first in the reservoir 2 and second in the inlet box 5, the pulp concentration is reduced to approximately 1%.

The diluted pulp is led from the inlet box 5 by overflow into the trough 6*a* of the first washing stage W1. A cylindrical drum 6 of wire mesh is rotated continuously clockwise while partially immersed in the pulp suspension in trough 6*a*. As is conventional, suction is drawn on the interior of the cylinder 6 by means not shown, so that the suspending liquor is drawn through the wire mesh of cylinder 6, and the pulp fibers are drawn down onto the surface of the wire mesh, forming a pulp web 6*b*. The liquor (filtrate) is withdrawn from the interior of the cylinder by the line 4*a*, and passed to the tank 4.

The drum 6, rotating clockwise, carries the web 6*b* of pulp fibers up to and beneath the array of spray nozzles 7, where relatively fresh washing liquor from tank 8 is sprayed onto the pulp web 6*b*. The liquor is fed to these nozzles via line 8*a* and pump P2 from the tank 8, and is the washing liquor from the second washing stage 12. This washing liquor has been utilized only once, in washing stage W2, and contains an appreciably lower content of dissolved solids than the liquor in tank 4. A part of this liquor also is drawn through the wire mesh of drum 6 by the suction, and passes by line 4*a* into the tank 4.

The washed pulp web is then scraped off the wire mesh by the doctor blade 9*a*, at the entry to the outlet box 9, and the separated pulp is collected in the outlet box 9 in aggregates or clumps of fibers of varying sizes. The outlet box includes a screw conveyor 10, for mixing the particles with liquid from filtrate tank 8. The solids content of the pulp at this stage is from 12 to 18%.

Outlet box 9 is in communication via line 9*b* and pump P3 with the tank 8, and liquor from the tank 8 is used to dilute the pulp in the box, so that a pulp suspension is formed at a pulp concentration of approximately 1%. This pulp suspension is then passed directly via line 8*c* to the inlet box 11 of the second washing stage W2, where the pulp suspension is fed by overflow into trough 12*a* and is taken up on the cylindrical wire mesh drum 12 exactly as in the first stage, by application of suction to the interior of the drum.

The liquor drawn through the mesh is brought to the tank 8 via the line 8*b* while a web 12*b* of pulp is formed on the surface of the drum. The pulp web is carried upwardly by the clockwise rotation of the drum to beneath the array of nozzles 14, which spray liquid thereon, conveyed thereto via line 13. This liquid is normally pure water, or a steam condensate obtained at some other treatment stage in the pulp mill, for example condensation of steam from the evaporators in the black liquor recovery system. The wash water from the nozzles 14 is drawn through the pulp web 12*b* into the interior of the drum 12, and then carried by line 8*b* to the tank 8. The pulp web 12*b* is brought against the doctor blade 16*a* at the inlet to the outlet box 16. The solids content of the pulp is from 10 to 15% at this stage, and the pulp again is stripped off the drum and collected in the outlet box in the form of aggregates or clumps of fibers of varying size. The outlet box 16 includes a conveyor screw 15 for mixing of the particles with dilution liquid via line 22 and valve 23 from line 21.

If the pulp web is too difficult to dewater, it is not possible to add all the wanted wash water through the nozzles 14. If one tries to do this, the result will be that a larger amount of wash water is transported out of the washing system via the pulp web at 16*a*. In order to improve this situation a portion (less than 50%) of the wash water added through 13 could be added directly in the inlet box 11 via line 11*a* and valve 11*b*, and serve as diluent.

Each of the filtrate tanks 4, 8 is provided with liquid level sensors 17, 18, the sensor 17 controlling valve 19 in the washing liquor discharge line 32, via control line 17*a*, and the sensor 18 controlling valve 20 in line 8*b* leading to the spray nozzles 7, via control line 18*a*. The recovered washing liquor in line 32, referred to as thin liquor, is passed to an evaporation stage via the line 32, for recovery of dissolved solids therein.

The washing system employs the counterflow principle, in which the water from the last washing stage W2 is used in sequence up the series of washing stages to the first washing stage W1, and then discharged. While only two washing stages are shown, it will be understood that one, two, three or more washing stages of like type can be interposed in series and in like interconnection between W1 and W2.

The process in accordance with the invention to control washing losses is applied to this washing system following the last washing stage, W2.

In order to continuously determine washing losses, it is necessary to measure continuously the following three variables:

(a) The volumetric flow rate of the cellulose pulp suspension.

The flow of pulp can be measured directly, for example, by means of a flowmeter, for example, a magnetic flowmeter; other types of flowmeters can be used.

(b) The liquid content of the pulp suspension following the last washing stage.

This parameter is difficult to measure. Any method of determining the liquid content of the pulp suspension which provides a reliable result can be used. It is however preferred to apply the method described below.

(c) The amount of organic and inorganic water-soluble material dissolved in the suspending liquid.

The content of these materials can be determined analytically using a number of available procedures as described below.

The determination of the liquid content of the pulp suspension (b) can be carried out in either of two ways, depending upon whether it is known how much pulp enters the washing system at line 1.

In order to supply the correct quantity of washing liquid through the line 13 and thereby correctly control the dilution factor, the liquid content of the pulp, which leaves the washing system when it is stripped from the filter 12 by the doctor blade 16*a*, must be determined.

Let it be assumed that this pulp has a solids content of 12%. The pulp in the outlet box 16 is then diluted with suspending liquor through line 21, 22, via valve 23. It has been found most suitable to dilute the pulp here to a concentration within the range from about 1 to about 10%, preferably from about 2 to about 5%. Although the dilution can be carried out in one step, it is suitably carried out in two steps, once at the outlet box 8 via lines 21, 22 and again beyond the outlet box via lines 21, 25 through valve 26. In this case, the first dilution in the outlet box 16 is a rough dilution, without applying precise measurement or control, and can be effected by the operator, using spot judgment, and manual control of the valve 23. After this rough dilution, the diluted pulp is passed via line 24, past the junction with line 25. Here, more suspending liquid is combined with the pulp, but the amount of suspending liquid introduced through the line 25 is controlled by the valve 26. This valve is in turn controlled by a pulp concentration measuring device 27, which automatically controls the amount of liquid added via line 25, to give the desired pulp concentration. The pulp concentration in line 24 normally is approximately 3%.

The quantity of diluting liquor required to obtain the desired pulp concentration is measured continuously by the flowmeter 28, which is, for example, of magnetic type, in the line 21. The total flow of pulp suspension departing from the system in line 24 is also measured continuously, by the flowmeter 29, which can be of the same type as the flowmeter 28. It should here be noted that nothing of the liquid entering through the line 21 and used for dilution of the washed pulp, is entering the actual washing system. It does not affect the dilution factor of the washing system and is used only to dilute the already washed pulp. Information concerning the amount or volume of flow in lines 21 and 24 can be collected by the signal converter 30, and this information together with the pulp concentration is used to continuously calculate the liquid content of the washed pulp, e.g., when the pulp leaves the last wash filter 12.

With the aid of the signal converter 30, the quantity of washing liquor supplied through the line 13 is then regulated via control valve 31, so as to obtain constant dilution of the pulp.

If the amount of cellulose pulp (calculated as absolutely dry pulp) flowing through the washing system is known, for example, by measuring the amount of pulp entering via line 1 into the reservoir 2, there is no need to measure the pulp concentration, and the measuring device 27 can be omitted. There is then a direct relationship between pulp concentration and the total flow of suspension in line 24. With a constant flow of pulp, calculated as absolutely dry pulp, the amount of diluent liquid flowing through the line 21 can be controlled directly by the total flow of suspension in line 24, so as to maintain a constant suspension flow. In this alternative approach, the flows in lines 21 and 24 are continuously measured by the flowmeters 28 and 29, as before.

The quantity of liquid accompanying the washed pulp from the washing process can be calculated as follows:

Let:

$Q$ = the total volume flow per unit of time.

$Q_{24}$ = the total volume of suspension flow per unit of time in the line 24.

$V$ = the total liquid volume flow per unit of time.

$V_{21}$ = the total liquid volume flow of diluent through line 21.

$V_{24}$ = the total liquid volume flow per unit of time through line 24.

$V_{pulp}$ = the liquid content of the pulp when the pulp leaves the last washing stage (at 16*a*).

m = the concentration of the pulp suspension in the line 24.

The pulp concentration measuring device 27 controls the flow of diluent $V_{21}$, so that the concentration of the pulp suspension in line 24 has the specific value m. The value of m is known from the pulp concentration meter 27, and is normally 3%, but it can vary from 1 to 10% as indicated previously. By measuring the suspension flow $Q_{24}$, the flow of cellulose fibers (calculated as absolutely dry pulp) can be calculated as $m \times Q_{24}$. the liquid volume flow in line 24 $V_{24}$ is then equal to:

$$V_{24} = Q_{24} - m \times Q_{24} = (1 - m)Q_{24}$$

When a liquid balance is established, the following relationship is obtained:

$$V_{pulp} + V_{21} = V_{24}$$

$$V_{pulp} = V_{24} - V_{21}$$

$$V_{pulp} = (1 - m)Q_{24} - V_{21}$$

where m is known from the pulp-concentration meter 27

$Q_{24}$ is measured in flowmeter 29

$V_{21}$ is measured in flowmeter 28

Thus, $V_{pulp}$ can be calculated and followed continuously,

As previously mentioned, the flow of cellulose fibers $= m \times Q_{24}$.

In this way, information is obtained as to the quantity of liquid per quantity of cellulose fiber leaving the washing system with the washed pulp.

When the production of cellulose pulp is known, for example by means of measurement upstream of the washing system, it is not necessary to measure the concentration of the pulp, as previously mentioned, and consequently no flowmeter 27 need be provided.

The amount of liquid accompanying the pulp from the washing filter 12 can be calculated in the following manner:

$V_{21}$ and $Q_{24}$ are measured $V_{24} = Q_{24}$—pulp production

The pulp production is expressed as unit volume/unit time as previously shown:

$V_{pulp} = V_{24} - V_{21}$, i.e.

$V_{pulp} = (Q_{24}$—pulp production$) - V_{21}$

In order to measure the amount of inorganic and organic dissolved impurities (c) in the suspending liquid, these materials are reacted with an oxidizing chemical. Examples of oxidizing chemicals which can be used include hypochlorous acid, chlorine, for example, chlorine water, sodium or potassium hypochlorite, chlorine dioxide, hydrogen peroxide, sodium and potassium bichromate. The preferred oxidizing chemical is hypochlorous acid HOCl.

The amount of inorganic and organic substances present also can be measured directly without addition of an oxidizing chemical by using ionselective electrodes, photometry, flame photometry, conductometry, or density measuring techniques. In a preferred method there is added to the sample of liquid an excess of aqueous hypochlorous acid solution. A specified period of time is allowed to elapse, and then the excess remaining hypochlorous acid determined analytically by means of iodotitration, polographic measurement, redox potential measurement, photometry, colorimetry, or similar processes.

The most suitable analytical method is one in which the liquid sample is mixed with an excess of aqueous hypochlorous acid solution, and the amount of heat developed measured calorimetrically. Surprisingly, it has been found that when hypochlorous acid is used at a pH of 5.5, the amount of precipitate and problems connected therewith are much less, thereby providing more reliable results, than when using alkaline hypochlorite at a pH of 10.

Hypochlorous acid and the other oxidizing chemicals referred to above react with the organic substances present in the suspending liquid and with that part of the inorganic materials present in the form of sulfate and thiosulfate. The remaining inorganic substances, probably the predominant portion, do not react with hypochlorous acid.

Accordingly, it is important to note that in the analytical techniques described above, no information is obtained regarding total washing losses, since this is not susceptible of determination analytically. Analysis according to the standardized procedure of SCAN C 30:73 will provide information solely relating to those impurities bound to sodium.

These analyses to some extent overlap one another, and therefore it is not possible to add the results of one analysis to the results of another and obtain a total for the washing losses. On the other hand, it is possible for one to estimate approximately, with the aid of the analytical techniques, the total washing losses that can be expected from the values obtained according to the present invention, or according to the analytical procedure of SCAN C 30:73.

Calorimetric techniques which can be used include those described in Hultman U.S. Pat. No. 3,888,726, patented June 10, 1975, which applies this technique to the control of pulping chemicals added in the delignification and/or bleaching of cellulose pulp.

The analytical methods described above also can be used to determine the solids content of the thin liquor or filtrate liquor recovered subsequent to the last washing stage, before it is sent on to the evaporation plant. The same method can also be used to analyze thick liquor subsequent to evaporation of the thin liquor and prior to charging thick liquor to the combustors. In this way, it is possible to estimate the fuel value of the thick liquor, which may be of interest.

The manner and stage at which the content of impurities of the suspending liquid is determined is shown in the FIGURE. A filtered liquid sample of washed suspension liquid is taken continuously from line 24 via line 34 to a continuously operating analyzer 35, for example, a calorimeter, where the content of dissolved impurities is measured. Since the flowmeter 29 measures the total flow of suspension in line 24, this is known, and is designated $Q_{24}$. If the pulp production is known, then the amount of liquid in line 24, designated $V_{24}$, is as follows:

$$V_{24} = Q_{24} - \text{pulp}.$$

When the pulp concentration m is measured and regulated by means of the pulp concentration meter 27, the amount of liquid in the line 24 is represented by the equation:

$$V_{24} = Q_{24} \times (1 - m)$$

The total outflow of dissolved impurities i.e., the washing losses, is then obtained by multiplying the amount of liquid by the content of dissolved impurities. This is carried out continuously in a computer 37. If the diluent in line 21 and the washing liquid in line 13 is pure water, the washing losses, i.e., the dissolved impurities remaining with the pulp due to incomplete washing, will be equal to the quantity of dissolved impurities. In reality, however, the washing liquid in line 21 is not water, but a liquid which is contaminated with both organic and inorganic material. Pure water is normally used as the washing liquid in line 13, although it is also possible here as well to utilize a liquid which contains small amounts of organic and/or inorganic material. Because of this, it is necessary to analyze the dissolved impurities content of the diluent and the washing liquid, when the washing liquid is not pure water.

The FIGURE shows only the set-up for an analysis of the diluent. In carrying out the analysis, a sample of liquid is continuously taken from the line 21 and passed through the line 33 to the continuously operating analyzer 35, which is in the form of a calorimeter, and in which the content of dissolved impurities is determined. As mentioned above, the flowmeter 28 measures the total liquid flow in line 21, and this flow is designated as $V_{21}$. The total amount of impurities introduced through line 21 is $V_{21}$ multiplied by the sample content of dissolved impurities. The calculation is made continuously in the computer 36. When the washing liquid is pure water, the washing losses of the pulp, designated $T_m$ is equal to the quantity of impurities in the line 24, designated $T_{24}$, minus the quantity of impurities in the line 21, designated $T_{21}$, divided by the pulp production P. In other words:

$$T_m = (T_{24} - T_{21}/P)$$

This calculation can be made continously, using the computers 30, 36 and 37. A signal can then be sent to control the supply of washing liquid to the washing stage W2, through the regulating valve 31.

When the washing liquid in line 13 contains dissolved impurities, corresponding measurements are made; the flow in line 13 and the dissolved impurities content of the liquid are determined continuously. In this case, the washing losses of the pulp are shown in the following equation:

$$T_m = \frac{T_{24} - (T_{21} + T_{13})}{P}$$

Thus, in accordance with the process of the invention, it is possible continuously to monitor the washing losses and to make adjustments in the amount of washing liquid added on the basis of these determinations. Thus, for the first time it is possible to wash the pulp both economically and in a manner to minimize the discharge of undesirable impurities from the plant.

If, for example, the washing losses are undesirably high, the amount of fresh suspending liquid or washing liquid charged to the system via line 13 is increased until the washing losses have been reduced to a desired level, i.e., a level at which the washing losses can be tolerated, both from the standpoint of the recovery of chemicals and the discharge of waste chemicals.

If the washing losses are undesirably low, the supply of fresh suspending liquid to the system via line 13 is reduced until the washing losses have been increased to the desired value, taking into account the cost of evaporation of liquids, due to excessive dilution, and the capacity of the washing system. In principle, it is desirable to maintain the washing losses as low as possible with respect to environmental problems and the purity of the manufactured pulp, while avoiding excessively high production costs, due to an excessively low washing loss.

The following Examples in the opinion of the inventors represent preferred embodiments of the invention.

EXAMPLES 1 to 15

The process of the invention was applied in a washing system similar to that shown in the FIGURE, but utilizing four wash filters of the type shown, in series. The system was then applied to the washing of birch Kraft pulp.

The pulp production was measured continuously in kilograms/minute upstream of the washing system, and therefore no pulp concentration meter 27 was used.

The concentration of the washed pulp suspension having the last washing stage in the series varied between 10 and 15% during the test period. This pulp suspension was diluted with white water from the screening system to a pulp concentration ranging from 3 to 4% during the test. The quantity of diluent in the line 21 was measured with the flowmeter 28, and information concerning the quantity of diluent $V_{21}$ was registered continuously on a recorder. In a similar manner, the flow of pulp suspension in line 24 was measured continuously by the flowmeter 29, so as to record $Q_{24}$.

In order to determine the quantity of dissolved impurities in the pulp suspending liquid, a flow of suspending liquid was taken from line 24 and passed via line 34 to the calorimeter 35. The flow of liquid was taken off through a filter placed in line 24, so that no cellulose fibers were present. Since the diluent comprised white water from the screening system, this system also contained small amounts of dissolved impurities. Because of this, a stream of liquid was taken from the line 21 and passed through a line 33 to the calorimeter 35 as well.

The liquid samples were passed continuously through the calorimeter, which had two cells. In the calorimeter each liquid sample was mixed with an aqueous solution of hypochlorous acid HOCl having a concentration of 5 g/liter, calculated as active chlorine. Distilled water was used as a reference solution. The reaction loops in the respective cells were sufficiently long, that the samples had a residence time of 1 minute 20 seconds in the cell. The heat generated by the reaction of dissolved impurities in the liquid with the hypochlorous acid was converted using a thermopile to an electric signal registered as millivolts continuously on a recorder.

Tests were also made in which the liquid samples were diluted with water two or five times. Identical analytical results were obtained in all series. Thus, two signals were obtained from the calorimeter, one from each liquid sample. These signals in millivolts were found to be proportional to the amount of dissolved impurities present in the liquid, according to the following formula:

$$C = 0.90X + 0.10$$

where

X equals the signal on the calorimeter in millivolts; and

C equals the amount of dissolved impurities in the liquid, corresponding to the amount of oxygen consumed in grams/liter.

With the aid of this formula, it is possible to calculate the quantity of dissolved impurities in the diluent, designated $C_{21}$, and in the pulp suspending liquid, designated $C_{24}$. Since the flow of diluent $V_{21}$ and the flow of pulp suspension $Q_{24}$ were known, it was possible to calculate continuously the washing losses of the pulp, designated as $T_m$, calculated in kilograms of oxygen consumed per ton of pulp, in accordance with the formula:

$$T_m = \frac{(Q_{24} - \text{pulp production}) \times C_{24} - V_{21} \times C_{21}}{\text{pulp production}}$$

Thus, in this way it is possible to calculate and record the washing losses of the pulp in a continuous manner.

During the test period, as a control, samples of the pulp suspension were also taken manually, just before the pulp web was removed from the filter drum 12. These pulp samples were analyzed for sodium in accordance with SCAN C 30:73, and calculated as kilograms of sodium sulfate per ton of pulp.

The samples were also analyzed for chemical oxygen demand COD of the liquid, according to the method devised by Industrins Vatten och Luftvard Aktiebolag, based on ASTM Test Designation D 1252-60. In brief, this method requires reacting the dissolved impurities of the sample liquid with 0.250 N potassium bichromate solution, $K_2Cr_2O_7$. This analysis gives information concerning the content of organic substances of the liquid sample, and also the sulfides part of the inorganic substances. The content of solubilized impurities is given as COD in grams of oxygen/liter, i.e., the amount of oxygen the substance will consume in order to be completely oxidized.

These two analyses were also applied to samples of the diluent.

The times at which the pulp samples were taken were noted, and the results obtained at the corresponding points of time in comparison with the results obtained using the method in accordance with the invention are apparent from the following Table.

TABLE I

| Example No. | Pulp production (kg/min) | Suspending Liquid from Pulp Suspension: Flow rate=$Q_{24}$ ($m^3$/min) | Calorimeter (mV) | Content=$C_{24}$ (g $O_2$/l) | Diluent: Flow=$V_{21}$ ($m^3$/min) | Calorimeter (mV) | Content=$C_{21}$ (g $O_2$/l | Washing losses (kg $O_2$/ton pulp) |
|---|---|---|---|---|---|---|---|---|
| 1 | 300 | 8.3 | 0.57 | 0.61 | 5.6 | 0.09 | 0.18 | 13 |
| 2 | 300 | 10.0 | 0.52 | 0.57 | 7.5 | 0.18 | 0.26 | 12 |
| 3 | 300 | 10.0 | 0.53 | 0.58 | 7.0 | 0 | 0.10 | 18 |
| 4 | 300 | 7.5 | 1.50 | 1.45 | 5.5 | 0.70 | 0.73 | 18 |
| 5 | 360 | 9.3 | 1.17 | 1.15 | 5.9 | 0.38 | 0.44 | 22 |
| 6 | 360 | 12.0 | 0.88 | 0.89 | 9.5 | 0.18 | 0.26 | 22 |
| 7 | 360 | 9.6 | 0.70 | 0.73 | 6.0 | 0 | 0.10 | 18 |
| 8 | 360 | 9.3 | 1.20 | 1.18 | 6.8 | 0.16 | 0.24 | 25 |
| 9 | 330 | 8.3 | 0.64 | 0.68 | 6.5 | 0 | 0.10 | 15 |
| 10 | 330 | 8.3 | 1.95 | 1.86 | 6.7 | 0.68 | 0.71 | 30 |
| 11 | 330 | 10.3 | 0.52 | 0.57 | 7.7 | 0.05 | 0.15 | 14 |
| 12 | 330 | 10.3 | 0.55 | 0.60 | 7.5 | 0 | 0.10 | 16 |
| 13 | 330 | 10.3 | 0.88 | 0.89 | 8.0 | 0.16 | 0.24 | 21 |
| 14 | 330 | 10.3 | 0.69 | 0.72 | 8.0 | 0.02 | 0.12 | 19 |
| 15 | 330 | 9.5 | 1.31 | 1.28 | 6.2 | 0.58 | 0.62 | 24 |

Corresponding results obtained with SCAN C 30:70 manual analysis are given in Table II.

TABLE II

| Example No. | Suspending Liquor from Pulp Suspension: COD g $O_2$/l | $Na_2SO_4$ g/l | Diluent: COD g $O_2$/l | $Na_2SO_4$ g/l | Washing Losses: COD kg $O_2$/ ton pulp | $Na_2SO_4$ kg/ton pulp |
|---|---|---|---|---|---|---|
| 1 | 0.61 | 0.65 | 0.18 | 0.19 | 13 | 13 |
| 2 | 0.57 | 0.60 | 0.26 | 0.28 | 13 | 13 |
| 3 | 0.57 | 0.63 | 0.02 | 0.02 | 19 | 20 |
| 4 | 1.31 | 1.50 | 0.73 | 0.85 | 18 | 19 |
| 5 | 1.17 | 1.31 | 0.44 | 0.52 | 22 | 25 |
| 6 | 0.90 | 0.99 | 0.27 | 0.30 | 22 | 24 |
| 7 | 0.73 | 0.80 | 0.09 | 0.10 | 18 | 20 |
| 8 | 1.19 | 1.31 | 0.25 | 0.26 | 25 | 28 |
| 9 | 0.68 | 0.75 | 0.08 | 0.10 | 16 | 16 |
| 10 | 1.83 | 2.10 | 0.71 | 0.82 | 31 | 35 |
| 11 | 0.58 | 0.63 | 0.15 | 0.17 | 14 | 15 |
| 12 | 0.60 | 0.66 | 0.10 | 0.11 | 16 | 17 |
| 13 | 0.89 | 0.98 | 0.25 | 0.28 | 20 | 24 |
| 14 | 0.72 | 0.79 | 0.12 | 0.13 | 18 | 21 |
| 15 | 1.28 | 1.42 | 0.62 | 0.68 | 25 | 29 |

In Table II the pulp production and volumetric rates of flow have not been given, since these figures have already been given in Table I. When the washing losses recorded in Table I are compared with corresponding values in Table II, it will be seen that there is an extremely good correlation between the values shown in Table I and obtained in accordance with the invention, and the values shown in Table II obtained by analyses in accordance with SCAN C 30:73.

As previously described, the preferred analytical reagent used to determine the amount of solubilized substance in the flows of sample liquid in the method according to the invention was hypochlorous acid, while the reagent used to determine the amount of solubilized impurities (i.e. the organic substance and part of the inorganic substance) in the liquid samples taken manually was potassium bichromate. These two reagents have been found to provide good results, with very good correlation. When making the analysis using calorimetric determinations, hypochlorous acid is to be preferred, however, for technical reasons.

It is possible to perform a regression analysis in which the calorimetric value in millivolts (mV) is plotted against the COD-value according to the IVL-method in gram $O_2$ per liter. With this analysis, the previously mentioned relationship:

$$c = 0.90X + 0.10$$

was obtained. Thus, in this way it has been possible to convert the indication in millivolts to an indication of the content of consuming chemical oxygen substances in the suspending liquid. In addition, it is possible to compare the washing losses, i.e. the quantity of solubilized impurities, measured as COD according to the IVL-method, with the washing losses measured as $Na_2SO_4$ according to the SCAN C 30:73 method. Such a comparison will show that the relationship between the quantity of Na given as $Na_2SO_4$ in grams per liter or kilogram per ton of pulp, and COD given as grams oxygen per liter is approximately 1:1. This relationship is empirical, and while it is applicable to sulphate-pulp manufacturing plants, it may require some modification for special conditions in a given plant.

The washing losses measured in accordance with the invention can be converted by means of the factor 1:1, however, and given in kilograms $Na_2SO_4$ per ton of pulp. When this is done, the following values are obtained:

TABLE II

| Example No. | Washing losses kg $Na_2SO_4$/ton pulp |
|---|---|
| 1 | 14 |
| 2 | 13 |
| 3 | 20 |
| 4 | 20 |
| 5 | 24 |
| 6 | 24 |
| 7 | 20 |
| 8 | 28 |
| 9 | 16 |
| 10 | 34 |
| 11 | 15 |
| 12 | 18 |
| 13 | 23 |
| 14 | 21 |
| 15 | 27 |

As will be evident from the aforegoing, it is possible by using the invention to continuously determine the washing losses of a washed sulphate cellulose pulp after washing of the pulp. The values obtained can be used to control the washing losses to the desired level.

EXAMPLES 16 to 21

In a sulphite-pulp manufacturing plant, the cellulose pulp suspension in black liquor was washed in a number of vessels. Subsequent to washing the pulp suspension was passed to a retention vessel, from which the pulp was pumped continuously to a terminal washing filter. The measuring apparatus shown and described in the FIGURE were incorporated, downstream of the terminal washing filter. In other respects, the same procedural steps as in Example 1 were carried out, with the one exception that the pulp being washed was sulphite pulp. The values obtained are given in Tables IV, V and VI.

TABLE IV

| Example No. | Pulp production (kg/min) | Suspending Liquid from Pulp Suspension: Flow rate=$Q_{24}$ $m^3$/min | Calorimeter (mV) | Content=$C_{24}$ (g $O_2$/l) | Diluent: Flow=$V_{21}$ ($m^3$/min) | Calorimeter (mV) | Content=$C_{21}$ (g $O_2$/l | Washing losses (kg $O_2$/ton pulp) |
|---|---|---|---|---|---|---|---|---|
| 16 | 400 | 13.3 | 0.37 | 0.76 | 9.7 | 0.25 | 0.50 | 37 |
| 17 | 400 | 13.3 | 0.32 | 0.65 | 9.3 | 0.22 | 0.43 | 35 |
| 18 | 400 | 13.3 | 0.31 | 0.63 | 9.3 | 0.23 | 0.45 | 28 |
| 19 | 400 | 10.3 | 0.39 | 0.80 | 6.7 | 0.36 | 0.73 | 28 |
| 20 | 400 | 10.3 | 0.20 | 0.39 | 6.7 | 0.11 | 0.19 | 20 |
| 21 | 400 | 10.3 | 0.19 | 0.36 | 6.7 | 0.08 | 0.12 | 20 |

The above values were obtained when applying the present invention. The individual values were taken from the recorders which continuously followed the pulp-washing procedure, and at those points of time at which the manually-taken samples were removed. The manually-taken and analyzed samples gave the following results:

TABLE V

| Example No. | Suspending Liquor from Pulp Suspension: COD g $O_2$/l | $Na_2SO_4$ g/l | Diluent: COD g $O_2$/l | $Na_2SO_4$ g/l | Washing Losses: COD kg $O_2$/ ton pulp | $Na_2SO_4$ kg/ton pulp |
|---|---|---|---|---|---|---|
| 16 | 0.74 | 0.23 | 0.49 | 0.17 | 38 | 12 |
| 17 | 0.68 | 0.22 | 0.43 | 0.14 | 36 | 12 |
| 18 | 0.62 | 0.20 | 0.47 | 0.15 | 27 | 9 |
| 19 | 0.80 | 0.26 | 0.72 | 0.23 | 28 | 9 |
| 20 | 0.36 | 0.12 | 0.18 | 0.06 | 20 | 6 |
| 21 | 0.36 | 0.12 | 0.12 | 0.04 | 19 | 6 |

There is extremely good correlation between the washing losses recorded in Table IV and the corresponding values in Table V, obtained according to SCAN C 30:73.

The values obtained when manually analyzing the COD value of the samples were placed against indications in millivolts obtained in calorimetric analyses in accordance with the invention, whereupon the following relationship was obtained:

$$C = 2.18\,X - 0.05$$

in which X is the signal from the calorimeter in millivolts, and c = the content of dissolved impurities of the liquor, corresponding to the amount of oxygen consumed in g/l. The contents $C_{24}$ and $C_{21}$ given in Table IV were calculated with the aid of this formula. When a comparison is made between this formula and the formula obtained when washing sulphate pulp according to Example 1, it will be found that the formulae deviate greatly from one another. This is explained by the fact that the dissolved impurities in the pulp-suspension liquid in sulphite plants gives a much lower heat when reacting with hypochlorous acid than do the dissolved impurities in sulphate pulp. It is desirable to determine the aforementioned relationship between the millivolt indication and the content of dissolved substance of the liquid in grams per liter in each particular case, i.e., in each sulphite-pulp manufacturing plant.

The relationship between washing losses expressed as COD and as sodium can be calculated from Table V. The following relationship is obtained:

$$Na_2O = COD \times 0.32$$

Within the sulphite-pulp manufacturing industry, washing losses of sodium are expressed as g/$Na_2O$ per liter or kg $Na_2O$ per ton of pulp. With the aid of this relationship, washing losses measured in accordance with the invention can be converted to kg $Na_2O$ per ton of pulp, as will be seen from the following Table:

TABLE VI

| Example No. | Washing losses kg $Na_2O$/ton of pulp |
|---|---|
| 16 | 12 |
| 17 | 12 |
| 18 | 9 |
| 19 | 9 |
| 20 | 6 |
| 21 | 9 |

It will be apparent from the foregoing that when washing sulphite pulp, (as when washing sulphate pulp) using the present invention, it is possible to follow the washing losses of the pulp continuously, and to express such losses in the usual manner. The obtained values can then be used to regulate the washing losses to a desired level.

Although the description is primarily concerned with washing chemical pulp, and to monitor continuously the results of the washing process, to measure the washing losses, the process of the invention can also be applied to the washing of semichemical, chemimechanical and mechanical pulp. In the manufacture of mechanical pulp by defibration of wood no chemicals are used, hence the pulp is not normally washed subsequent to being manufactured. When mechanical pulp is bleached, however, and it is desirable to wash the pulp subsequent to bleaching the same, the present invention can then be applied to advantage.

The invention is not restricted to the washing of cellulose pulp, but it can also be used for washing any form of fibrous suspension. Other regions in which the invention can be applied to advantage include the washing of sludge in purification plants, and in the washing of fibrous suspensions in sugar-producing factories.

While the invention has been illustrated in the drawings by wash filters in two or more stages, the invention can be applied to the washing of fibrous suspensions in any kind of apparatus used for the continuous washing of fibrous suspensions, and especially cellulose pulp, for example, pressure washing and continuous digester washing processes, as described in Rydholm, *Pulping Processes,* pages 722 to 733, inclusive, and in continuous diffuser washing, as in a Kamyr Continuous Diffuser. This type of continuous diffuser has an outer casing within which there are a number of concentric double-sided screen rings. Each screen ring is fastened to radial drainage arms with vertical lifting bars at the ends, which in turn are connected to hydraulic cylinders. The pulp enters in the bottom of the conical part of the casing and moves upwards.

The automatically regulated hydraulic cylinders are lifting the screen unit with approximately the same speed as the pulp suspension is moving upwards. At the end of the lift the extraction is momentarily shut off whereafter the screen unit makes a rapid downward movement, clearing the screen surface.

Above the screen unit rotates a set of scraper-arms, on which the nozzles for distribution of wash liquor are fastened.

The wash liquid displaces the liquor in the pulp, which in turn is extracted through the concave and the convex sides of the screen rings.

The displacement liquor, thus collected by the screens, is flowing down to the drainage arms and to a collecting pipe or header outside the shell.

The washed pulp is discharged at 10% with scraper plates erected on the rotating arm to a common outlet in the same manner as a conventional upflow bleaching tower.

Alternatively the washed pulp is diluted to 5% consistency. Dilution liquid is added through nozzles, which are erected on the distribution arms. Pulp and dilution liquid are mixed by the rotating arms. In this case the pulp level is kept constant above the rotating arms and the pulp outlet in order to avoid air entrainment in the pulp suspension to be discharged.

Having regard to the foregoing disclosure, the following is claimed as the inventive and patentable embodiments thereof:

1. A process for continuously washing fibrous suspensions in aqueous suspending liquors containing dissolved impurities, to remove said impurities by exchanging aqueous suspending washing liquid substantially free from said impurities for the aqueous suspending liquor containing impurities, controlling washing losses that are obtained in the continuous washing of the fibrous suspensions due to the dissolved impurities remaining with the washed fibrous suspensions, which comprises in a continuous flow-washing system having at least one washing stage washing fibrous material of the suspension with the aqueous suspending washing liquid substantially free from dissolved impurities, and forming a washed fibrous suspension in said washing liquid, separating from the washed fibrous suspension and withdrawing from the washing stage and recirculating back to the washing stage aqueous suspending liquor containing dissolved impurities washed out from the fibrous suspension; diluting the washed fibrous suspension from the washing stage by adding aqueous suspending liquid capable of dissolving impurities; measuring (1) the volumetric flow rate of the washed suspension from the washing system, (2) the liquid content of the washed suspension from the washing system, and (3) the amount of dissolved impurities in the suspending liquid of the washed suspension from the washing system; and using these measured values to determine continuously the amount of dissolved impurities remaining with the fibrous suspension from the washing system after the washing has been completed; and then controlling the volume amount of wash liquid added to the fibrous suspension in the washing system according to the washing losses leaving with the washed fibrous suspension from the washing system, to maintain washing losses within a predetermined limiting range.

2. A process according to claim 1, in which the fibrous suspension is a cellulose pulp suspension selected from the group consisting of chemical pulps, mechanical pulps, chemimechanical pulps, semichemical pulps, and thermomechanical pulps.

3. A process according to claim 2, in which the pulp is a chemical pulp selected from the group consisting of sulfite pulps, sulfate pulps, and pulps obtained from the oxygen alkali pulping of lignocellulosic material.

4. A process according to claim 1, wherein the determination of the liquid content of the washed undiluted fibrous suspension is by diluting the washed suspension with aqueous suspending washing liquid substantially free from dissolved impurities; measuring the amount of such suspending washing liquid added thereto, and then measuring the volumetric flow rate of the washed fibrous suspension.

5. A process according to claim 4, which further comprises measuring the fiber concentration of the washed fibrous suspension.

6. A process according to claim 1, wherein the determination of the quantity of dissolved impurities in the suspending liquor is by reacting said substance with an oxidant, and measuring the heat liberated calorimetrically.

7. A process according to claim 6, in which the oxidant is hypochlorous acid.

8. Apparatus for continuously washing fibrous suspensions in aqueous suspending liquors containing dissolved impurities, to remove said impurities by exchanging aqueous suspending washing liquid substantially free from said impurities for the aqueous suspending liquor containing impurities, controlling the washing losses that are obtained in the continuous washing of the fibrous suspensions due to the dissolved impurities remaining with the washed fibrous suspensions which comprises in a continuous flow-washing system having at least one washing stage means for washing fibrous material of the suspension with the aqueous suspending washing liquid substantially free from dissolved impurities, and forming a washed fibrous suspension in said washing liquid; means for separating and withdrawing from the washing stage and means for recirculating back to the washing stage aqueous suspending liquor containing dissolved impurities washed out from the fibrous suspension; means for diluting the washed fibrous suspension from the washing stage by adding aqueous suspending liquid substantially free from dissolved impurities; means for separately measuring (1) the volumetric flow rate of the washed suspension from the washing system; (2) the amount of liquid in the washed suspension from the washing system; and (3) the amount of dissolved impurities in the suspending liquid of the washed suspension from the washing system; and means for using these measured values to determine continuously the amount of dissolved impurities remaining with the fibrous suspension from the washing system; and means for supplying the volume amount of fresh aqueous suspending liquor added to the fibrous suspension in the washing stage according to the washing losses leaving with the washed fibrous suspension from the washing system to maintain washing losses within a predetermined limiting range.

* * * * *

UNITED STATES PATENT AND TRADEMARK OFFICE

CERTIFICATE OF CORRECTION

PATENT NO. : 4,138,313

DATED : February 6, 1979

INVENTOR(S) : Per A. R. Hillstrom et al

It is certified that error appears in the above-identified patent and that said Letters Patent are hereby corrected as shown below:

Column 15, line 49 : "Table II" should be --Table III--.

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*